455/5

United States Patent [19]
Yamazaki et al.
[11] 4,114,150
[45] Sep. 12, 1978

[54] ALARM SYSTEM

[75] Inventors: Shunji Yamazaki, Yokohama; Hajime Masuda, Tokyo, both of Japan

[73] Assignee: Hochiki Corporation, Tokyo, Japan

[21] Appl. No.: 833,072

[22] Filed: Sep. 13, 1977

[51] Int. Cl.² ..... G08B 1/08

[52] U.S. Cl. ..... 340/531; 340/310 R; 325/308

[58] Field of Search ..... 340/288, 310 R, 531; 325/308; 178/DIG. 1, DIG. 23

[56] References Cited

U.S. PATENT DOCUMENTS 3,996,578 12/1976 Takeuchi et al. ..... 340/416

*Primary Examiner*—Alvin H. Waring
*Attorney, Agent, or Firm*—Haseltine, Lake & Waters

[57] ABSTRACT

In an alarm system utilizing a bidirectional wired television system, there are provided a plurality of alarm signal transmitters which are located on the subscriber's side, the signal transmitters generating low frequency signals of the frequencies common to respective group units, the frequencies being different for respective subscribers in respective group units, each alarm signal transmitter being provided for each subscriber, modulators for respective group units for modulating the low frequency signals from the alarm signal transmitters with different high frequency carrier signals, and a receiving panel for receiving the modulated signals. The receiving panel is provided with a plurality of demodulators for respective group units to demodulate the modulated signals and thereby to discriminate the group units in accordance with the high frequencies of the carrier signals, a plurality of detectors for receiving in common the outputs of the demodulators to detect the demodulated signals and thereby to discriminate the subscribers in accordance with the low frequencies of the low frequency signals, a plurality of display devices provided one for each alarm signal transmitter and grouped in the same manner therewith so as to be selectively actuated by the output of the detectors in common in respective groups and thereby to allow each subscriber to provide a corresponding display, and switching means and a scanning controller for sequentially energizing both the demodulators and the group units of the display devices.

6 Claims, 4 Drawing Figures

ALARM SYSTEM

BACKGROUND OF THE INVENTION

This invention relates to an alarm system utilizing a bidirectional wired television system.

According to already proposed alarm system utilizing a CATV system, the alarm signals from respective subscriber's ends are sent out from an alarm transmitter as low frequency signals having different frequencies for respective subscribers and the low frequency signals are grouped for suitable blocks and are modulated with high frequencies which are different for respective blocks to form incoming signals which are transmitted to an alarm receiving panel. The alarm receiving panel is provided with a circuit for discriminating the subscriber's ends on the transmission side. This discriminating circuit comprises a demodulator including a high frequency band pass filter and a plurality of low frequency band-pass filters. The demodulator which is provided with the high frequency bandpass filter functions to demodulate modulated signals which have been modulated with high frequencies different for respective groups as described above. Accordingly, it is necessary to use a plurality of demodulators of the same number as that of the modulators. Signals grouped into a plurality of blocks by the demodulators provided with bandpass high frequency filters are finally separated by a plurality of low frequency bandpass filters to operate respective display devices respectively corresponding to the original subscriber's ends.

This system, however, requires the use of a plurality of low frequency bandpass filters for each demodulator. Further, it is also necessary to install a plurality of low frequency bandpass filters of the same number as that of the subscriber's ends for the receiving panel. Accordingly, as the number of subscriber's ends increases the cost of the alarm system also increases and accurate separation of the signals becomes difficult, thus causing faulty operation as well as erroneous display.

U.S. Pat. No. 3,996,578 discloses an alarm system constructed to overcome the above-mentioned deficiencies. In the alarm system of this patent, the alarm receiving panel is provided with a plurality of demodulators for respective groups, a plurality of first bandpass filters corresponding to the high frequency carrier signals utilized for modulation and connected to apply modulated alarm signals to the demodulators, a plurality of first display means responsive to the output of the demodulators to provide first displays for the respective groups, a plurality of second bandpass filters corresponding to the low frequencies for the respective subscribers, means for supplying the outputs of all of the demodulators in common to all of the second bandpass filters, and a plurality of second display means connected to the outputs of the second bandpass filters to provide second displays for the respective subscribers. With this alarm system, the subscriber which has transmitted an alarm signals is indicated by the combination of the first and second displays, that is, the first display discriminates the corresponding group and the second display discriminates the corresponding subscriber in the group. A disadvantage of this alarm system is that while it is possible to discriminate one or plurality of subscribers in one group, if this group is the one and only group indicated by the first display, if two or more groups are displayed by the first displays and at the same time two or more subscribers are displayed by the second displays, the system is not able to discriminate the relationship between the groups and the subscribers.

SUMMARY OF THE INVENTION

It is the object of this invention to provide an improved alarm system utilizing a wired television system in which the number of filters in the receiving panel is reduced to the minimum of the requirement by adapting the filters for common use by the demodulators and in which each of the subscribers is allowed to provide its own display, thus ensuring accurate discrimination of subscribers even in cases where a plurality of subscribers in a plurality of groups simultaneously generate alarm signals.

In accomplishing the above and other equally important objects of this invention, the alarm system of this invention which is basically identical in construction with the previously mentioned alarm system of U.S. Pat. No. 3,996,578 excepting the circuit construction of the alarm signal receiving panel, features an improved circuit construction of the alarm signal receiving panel. In other words, the alarm system of this invention differs from the alarm system disclosed in U.S. Pat. No. 3,996,578 in that the alarm signal receiving panel includes a plurality of display means which are provided one for each of the subscribers. The plurality of subscribers are formed into a plurality of groups and the plurality of display means are correspondingly formed into the similar plurality of groups. The receiving panel of this invention further includes a plurality of demodulators corresponding to the groups and each having a frequency selecting function, and a plurality of detectors having a frequency selectivity and adapted to receive the demodulated signals in common from all of the outputs of the demodulators, with the respective detectors being adapted to select and detect the low frequency signals of different frequencies which are generated from the subscribers in each of the groups to thereby actuate the corresponding display means. The receiving panel further includes a scanning controller for sequentially scanning group by group the demodulators and the display means, whereby the demodulators and the groups of the plurality of display means are sequentially energized by the scanning controller. With the alarm system of this invention constructed as above described, when a plurality of subscribers in one group generate alarm signals, the display means corresponding to these subscribers provide displays, and when the subscribers in two or more groups simultaneously generate alarm signals, the display means corresponding to all the subscribers which have generated the alarm signals, provide the necessary displays in the respective groups. In accordance with this invention, the necessary frequency selecting elements provided in the receiving panel include, for example, as many high frequency bandpass filters as there are the groups and as many low frequency bandpass filters as there are the subscribers in each of the groups, and if, for example, the subscribers are formed into eight groups each thereof consisting of 10 subscribers, a total number of the filters required for discriminating as many subscribers as $8 \times 10 = 80$ is only 18.

The present invention will be more readily understood from the following detailed description taken in conjunction with the accompanying drawings.

DESCRIPTION OF THE PREFERRED EMBODIMENTS

Figure 1:
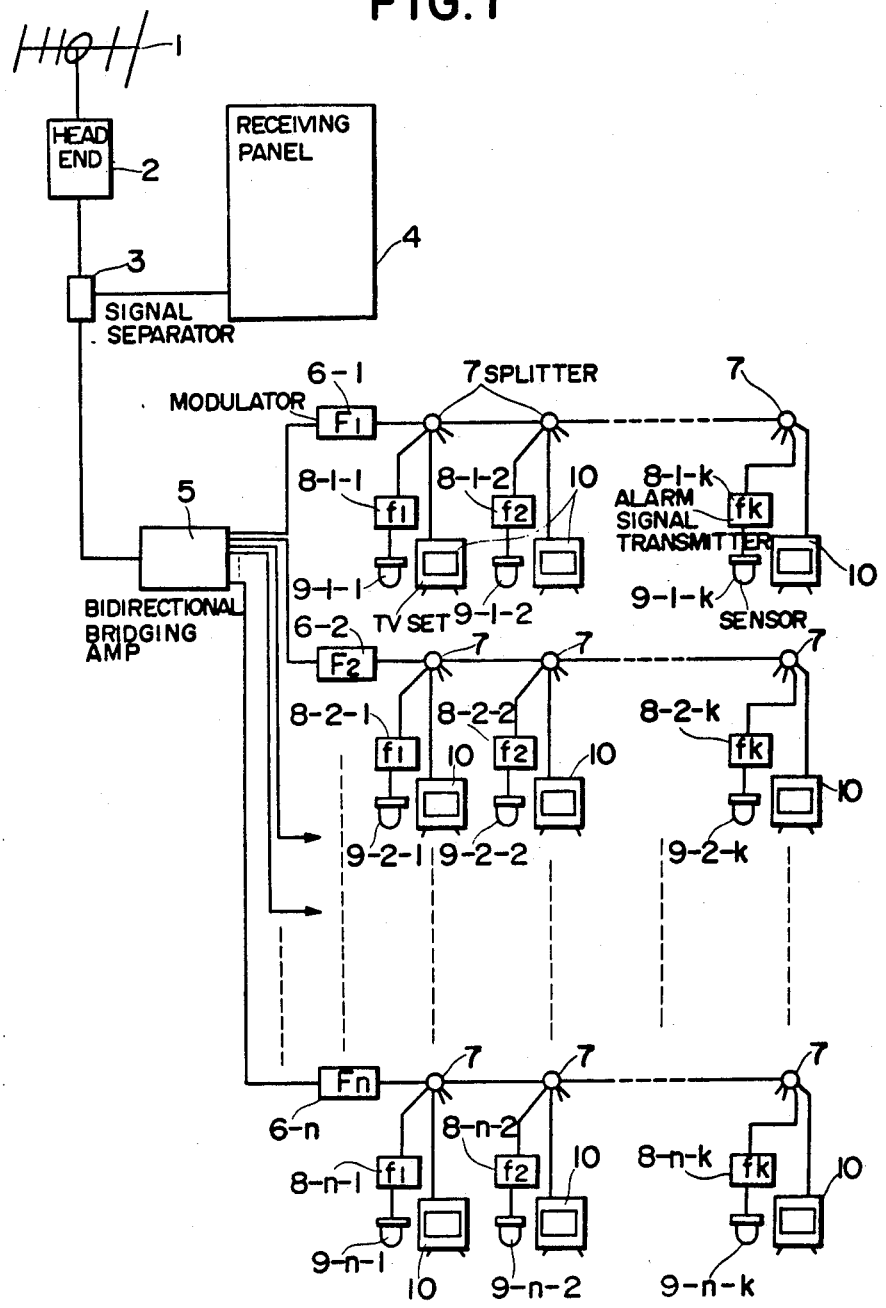
FIG. 1 is a block diagram showing an embodiment of an alarm system utilizing a CATV system, in accordance with the invention.

The alarm system shown in FIG. 1 comprises a common television receiving antenna 1, a head end 2, a signal separator 3 for separating television signals and alarm signals, an alarm receiving panel 4 connected to the signal separator 3 to receive the separated alarm signals and a bidirectional bridging amplifier 5 connected to the signal separator 3 to receive the television signals and adapted to pass modulated signals prepared by modulating incoming alarm signals from respective subscriber's ends. There are also provided a plurality of alarm signal modulators 6-1 through **6-*n* which function to modulate low frequency signals generated by alarm signal transmitters 8-1-1 through 8-*n*-*k* in respective group units with high frequency carrier signals having different frequencies for respective group units, a plurality of bidirectional splitters 7 for splitting television signals to respective household television receiving sets 10, and a plurality of hazard sensors 9-1-1 through 9-*n*-*k* (for example smoke sensors) connected to respective alarm signal transmitters. Each one of the alarm signal transmitters 8-1-1 through 8-*n*-*k* is assigned frequencies $f_1 \sim f_k$ for respective group units and each subscriber is permitted to use one of these frequencies. Frequencies $F_1 \sim F_n$ are assigned to respective group units so that modulators 6-1 through 6-*n*** operate to modulate signals generated by respective alarm signal transmitters and having frequencies $f_1 \sim f_k$ with frequencies $F_1$ through $F_n$ respectively.

The head end 2 amplifies and shapes signals and transmits the same to the television receivers through receiving antennas. It is, as in known, composed, for example, of branching filters for branching the receiving signals into each television channel, an amplifier, a mixer, and so forth.

The alarm system described above operates as follows.

The television signals taken as an outgoing signal is received by antenna 1 and are regulated by head end 2. A local broadcasting program or the like is applied directly to the head end 2. These television signals are applied to bidirectional splitters 7 via signal separator 3, bidirectional bridging amplifier 5 and alarm signal modulators 6-1 through **6-*n* without being modulated. Television signals reaching the splitters 7 are splitted to television receiving sets 10** of respective subscribers.

Signals generated by hazard sensors 9-1-1 through **9-*n*-*k* are applied to respective alarm signal transmitters 8-1-1 through 8-*n*-*k* so as to generate low frequency signals having frequencies $f_1$ through $f_k$ respectively. The low frequency signals are sent to respective modulators 6-1 through 6-*n* via bidirectional splitters 7 to be respectively modulated by frequencies $F_1$ through $F_n$. The modulated signals are then applied to the signal separator 3 through bidirectional bridging amplifier 5 to be separated from television signals. The separated signals are applied to the receiving panel 4**.

Figure 2:
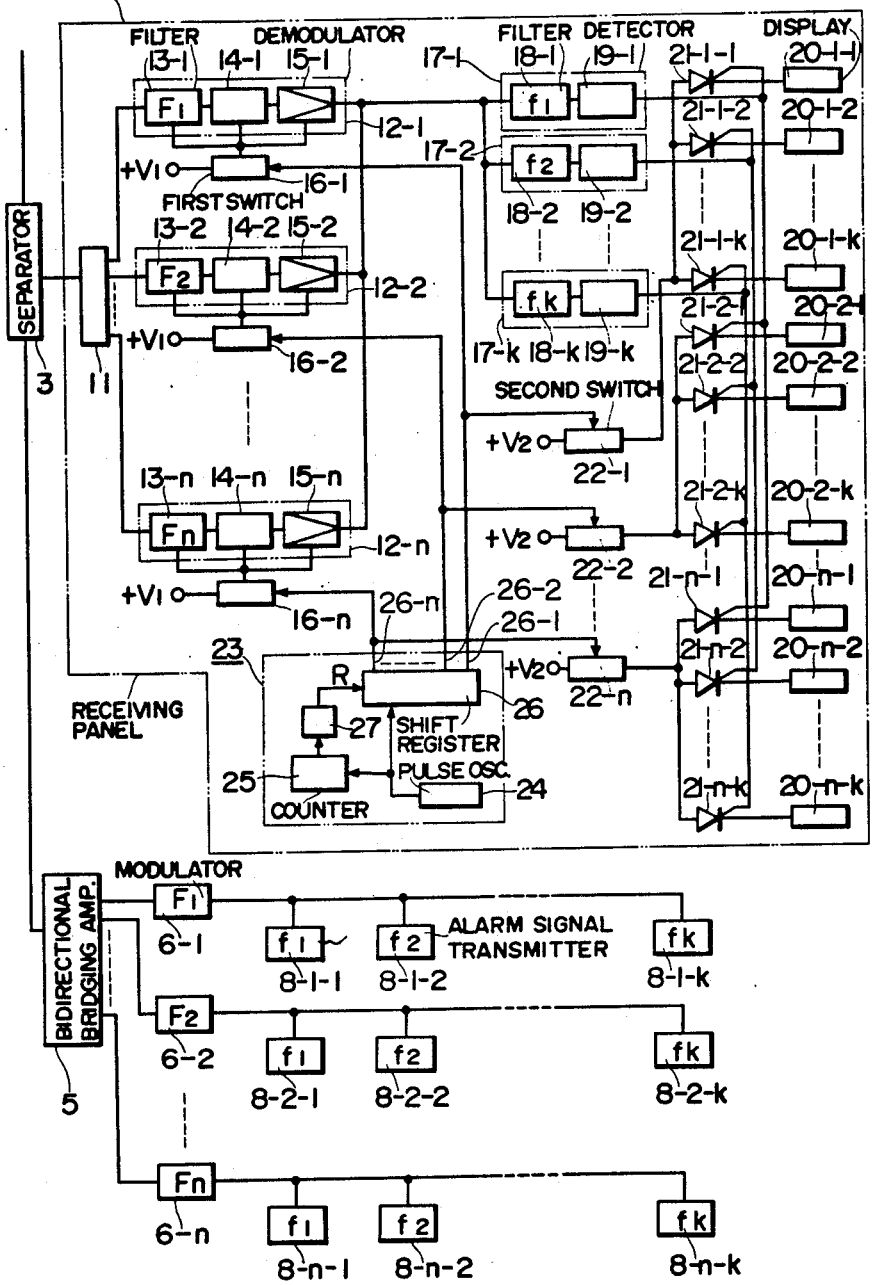
FIG. 2 is a block diagram showing the circuit construction of the alarm signal receiving panel used in the embodiment of FIG. 1 together with the alarm signal transmitters and the modulators.

FIG. 2 shows in detail the construction of the receiving panel 4 used in the first embodiment of this invention. As shown, the receiving panel 4 comprises a distributing amplifier 11 which comprises an amplifier and a signal divider and is a known device. The input from the signal separator 3 to the distributing amplifier 11 is branched in parallel and delivered through its output terminals of the same number (hereinafter referred to as an *n*) as that of the groups, and the output terminals of the amplifier 11 are each connected to the corresponding one of *n* demodulators 12-1 through **12-*n*. The demodulators 12-1 through 12-*n* are respectively provided in their stages with frequency selecting devices 13-1 through 13-*n*, so that the high frequency signal having one of the high frequencies $F_1$ through $F_n$ corresponding to the associated group unit, is selected by each selecting device from the modulated signal delivered through the output terminal of the amplifier 11. Each of the frequency selecting devices 13-1 through 13-*n* may for example be a bandpass filter, tuning circuit, resonator or the like. In the Figure, the demodulators 12-1 to 12-*n* respectively comprise the frequency selecting devices 13-1 to 13-*n*, demodulating circuits 14-1 to 14-*n* and amplifiers 15-1 to 15-*n* which constitute series connected stages therein, and a power supply voltage $+V_1$ is applied to the demodulators through first switching means 16-1 to 16-*n*. The first switching means 16-1 to 16-*n* may each comprise, for example, a switching transistor or an analog switching device of the type which is called as a bilateral switch, e.g., the RCA CD-4016 AE, and in case the switching means comprises a transistor, a switching control signal is applied to its base electrode to apply the supply voltage to the demodulator and thereby to energize the demodulator. The outputs of the demodulators 12-1 to 12-*n* are all connected in common to the inputs of detectors 17-1 to 17-*k*. The detectors 17-1 to 17-*k* are provided to detect the demodulated signals applied from the demodulators for the respective subscribers, and they are respectively provided in their input stages with low frequency bandpass filters 18-1 to 18-*k*. The filters 18-1 to 18-*k* are respectively responsive to the low frequencies $f_1$ to $f_k$, and these frequencies are equivalent to the low frequencies which are assigned to the alarm signal transmitters of the subscribers in common for each of the group units. In the Figure, the detectors 17-1 to 17-*k* respectively comprise the filters 18-1 to 18-*k* and detector circuits 19-1 to 19-*k***, which constitute series connected stages therein.

The receiving panel 4 further includes the same number of display devices 20-1-1 to **20-*n*-*k* as that of the subscribers, and the display devices are formed into the similar group units as the subscriber's alarm signal transmitters 8-1-1 to 8-*n*-*k*. In other words, in the Figure the display device 20-1-1 corresponds to the transmitter 8-1-1, the display device 20-2-1 to the transmitter 8-2-1 and so on, and the display device 20-*n*-*k* corresponds to the transmitter 8-*n*-*k*. The groups of the display devices are respectively connected to second switching means 22-1 to 22-*n* through semiconductor control devices or thyristors 21-1-1 to 21-*n*-*k*, and the second switching means 22-1 to 22-*n* control the application of supply voltage $V_2$ to the display devices. When the supply voltage $+V_2$ is applied to the display device, the display device continuously provides its display even after the turning off of the associated thyristor. The second switching means 22-1 to 22-*n* are similar with the first switching means 16-1 to 16-*n*, and each of the associated pairs of the first and second switching means, i.e., 16-1 and 22-1, 16-2 and 22-2 . . . 16-*n* and 22-*n*, comes into operation when a switching control signal is simultaneously applied to the pair. The gate electrodes of the thyristors 21-1-1 to 21-*n*-*k* are connected in groups to the common outputs of the detectors 17-1 to 17-*n*. In other words, the output of the detector 17-1 is connected to the thyristors 21-1-1, 21-2-1 . . . 21-*n*-1, the output of the detector 17-2 to the thyristors 21-1-2, 21-2-2 . . . 21-*n*-2 and so on, and the output of the detector 17-*k* is connected to the thyristors 21-1-*k*, 21-2-*k* . . . 21-*n*-*k*. Thus, the thyristors are connected in matrix form to the detectors and the second switching means so that when the outputs of the detector and second switching means are simultaneously applied to the thyristor, a particular display device which is dependent on the combination of the detector and second switching means comes into operation. The receiving panel 4 further includes a scanning controller 23 which is provided to apply a switching control signal to the first and second switching means. The scanning controller 23 comprises a clock pulse generator 24 for always generating clock pulses of a predetermined repetition period, for example, 200 msec., a counter 25** (counter of arbitrary number *n*) for generating a pulse each time the same number of clock pulses as that of the group units are counted, a shift register 26 having as many output terminals as the said number *n*, and a one-shot multivibrator 27. The output of the clock pulse generator 24 is connected to the counter 25 and the shift register 26, so that in response to each of the clock pulses applied, the shift register 26 sequentially generates an output at its output terminals 26-1 to **26-*n*, and this output is used as the previously mentioned switching control signal. The counter 25 counts clock pulses and applies a pulse signal to the one-shot multivibrator 27** for every *n* clock pulses counted, so that each time a pulse signal is applied from the counter 25, the one-shot multivibrator 27 applies a reset pulse of a predetermined pulse width which is shorter than the clock pulse period to the reset input terminal of the shift register 26. The shift register 26 has its output terminal 26-1 connected to the switching means 16-1 and 22-1, the output terminal 26-2 to the switching means 16-2 and 22-2 . . . and the output terminal **26-*n* to the switching means 16-*n* and 22-*n***.

Figure 3:
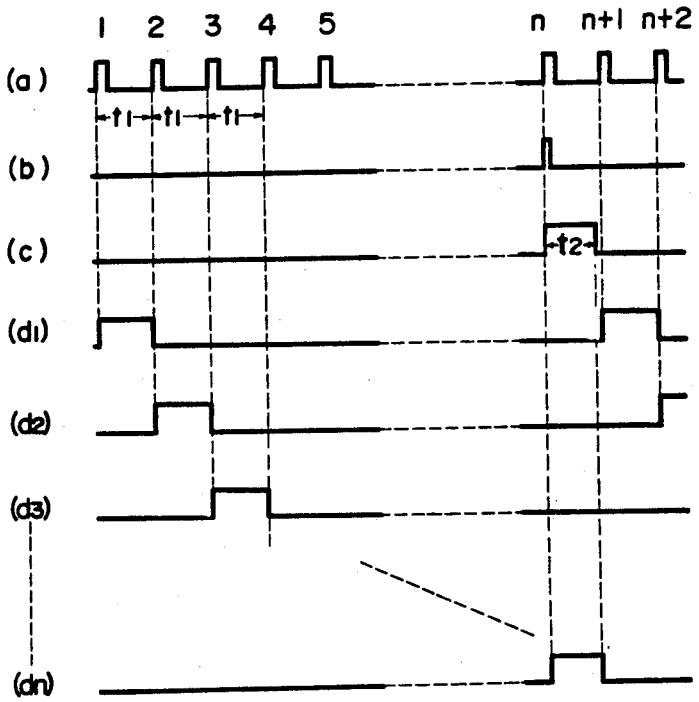
FIG. 3 is a signal waveform diagram useful for explaining the operation of the embodiment shown in FIG. 2.

The operation of the alarm system shown in FIG. 2 will now be described with reference to FIG. 3. The clock pulse generator 24 continuously generates clock pulses of a period $t_1$ as shown by the waveform (*a*) of FIG. 3. These clock pulses are applied to the counter 25 and the shift register 26. When the first clock is applied to the shift register 26, the shift register 26 is set by the leading edge of this clock pulse thus generating at its first output terminal 26-1 a pulse signal having the pulse width $t_1$ as shown by the waveform ($d_1$) of FIG. 3. When the second clock pulse is applied to the shift register 26, the pulse signal is shifted to the second output terminal 26-2 as shown by the waveform ($d_2$) of FIG. 3, and the third clock pulse shifts the pulse signal to the third output terminal 26-3 as shown by the waveform ($d_3$) of FIG. 3. In the like manner, the pulse signal is shifted to the nth output terminal **26-*n* as shown by the waveform ($d_n$) of FIG. 3** in response to the application of the *n*th clock pulse. The counter 25 generates an output pulse as shown by the waveform (*b*) of FIG. 3 for every *n* clock pulses counted, and this output pulse is applied to the one-shot multivibrator 27 which in turn generates a reset pulse of a pulse width $t_2$ as shown by the waveform (C) of FIG. 3. This reset pulse is applied to the reset pulse input terminal of the shift register 26, and consequently the shift register 26 is cleared at the expiration of the time $t_2$ after the positive going transition of the nth clock pulse. When the $(n+1)$th clock pulse is applied to the shift register 26, a pulse signal is again generated at its first output terminal 26-1, and in this way the same operation as mentioned previously is repeated for every *n* clock pulses.

As mentioned above, a pulse output is sequentially generated at the output terminals of the shift register 26 from the terminal 26-1 to the terminal **26-*n*, and after the pulse output has been generated at the output terminal 26-*n* the operation is started again at the output terminals of the shift register 26 is connected to the first and second switching means for each group unit, when an output pulse is generated at the output terminal 26-1, the switching means 16-1 and 22-1 are actuated, thus energizing both the demodulator 12-1 and the display devices 20-1-1 to 20-1-*k* which are respectively connected to the thyristors 21-1-1 to 21-1-*k*. As the output pulse at the output pulse 26-1 is shifted to the next output terminal 26-2, the demodulator 12-2 is energized in place of the demodulator 12-1 and at the same time the thyristors 21-2-1 to 21-2-*k* and the display devices 20-2-1 to 20-2-*k* are energized in place of the thyristors 21-1-1 to 21-1-*k* and the display devices 20-1-1 and 20-1-*k*. In this way, the switching means 16-1 to 16-*n* and 22-1 to 22-*n* are sequentially actuated in response to the shifting of the pulse signal at the output terminals of the shift register 26, and this operation is performed repeatedly. Thus, the display device groups 20-1-1 to 20-1-*k*, 20-2-1 to 20-2-*k* . . . 20-*n*-1 to 20-*n*-*k* and the demodulators 12-1 to 12-*n*** corresponding to the respective group units, are sequentially energized for the time $t_1$.

As, for example, when the transmitter **8-1-*k* in the first alarm signal transmitter group comes into operation in response to the operation of the sensor or the operation of the manual switch button, a continuous low frequency signal of frequency $f_k$KHz is applied from the transmitter 8-1-*k* to the modulator 6-1. In the modulator 6-1, the carrier signal of frequency $F_1$MHz is modulated with the low frequency signal of frequency $f_k$KHz, so that this modulated signal is delivered through the bridging amplifier 5 and the signal separator 3 to the receiving panel 4, and it is then applied to the distributing amplifier 11 in the receiving panel 4. The modulated signal applied to the amplifier 11 is delivered to all its output terminals and applied to all the demodulators 12-1 to 12-*n*. However, since the carrier frequency of this modulated signal is $F_1$MHz, the resulting demodulated signal is transmitted to the detectors 17-1 to 17-*n* only when the demodulator 12-1 controlled by the shift register 26 of the scanning controller 23 and the first switching means 16-1 is in the energized condition. When the switching means 16-1 is actuated by the controller 23, the display devices 20-1-1 to 20-1-*k* are also energized in response to the actuation of the second switching means 22-1, with the result that the low frequency signal of frequency $f_k$KHz demodulated by the demodulator 12-1 is applied to all the detectors 17-1 to 17-*n* and only the detector 17-*k* generates an output signal. Consequently, while, at that time, the supply voltage $V_2$ is applied to the thyristors 21-1-1 to 21-1-k, the output signal of the detector 17-k is applied as a gate triggering signal to the thyristor 21-1-k alone so that only the display device 20-1-k which is connected to the thyristor 21-1-k provides a display and the display device 20-1-k maintains its display by virtue of the self-holding function possessed by the display device itself even after the thyristor 21-1-k is turned off. In this way, only the display device 20-1-k corresponding to the transmitter 8-1-k comes into operation, while on the other hand no input signal is applied to the other display devices belonging to the same first group as the display device 20-1-k by virtue of the frequency selection function of the other detectors, and also no input signal is applied to the display devices 20-2-1 to 20-2-k . . . 20-n-1 to 20-n-k** of the other groups by virtue of the frequency selection function of the other demodulators. In the event that any other transmitter simultaneously generates a low frequency signal in the course of the above-mentioned operation, the corresponding display device is energized according to the operating timing of the associated first and second switching means, thus simultaneously providing a plurality of displays accurately.

Figure 4:
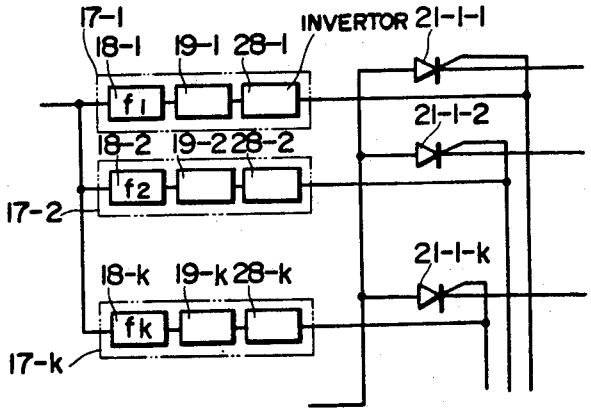
FIG. 4 is a block diagram showing the principal part of the alarm signal receiving panel used in another embodiment of the invention.

With the embodiment shown in FIG. 2, each of the alram signal transmitters generates a low frequency signal only when it is actuated, and the low frequency is then subjected to the process of frequency selection in the receiving panel so as to discriminate the corresponding subscriber. However, it is possible to arrange as shown in FIG. 4 so that the outputs of the detectors 17-1 to 17-n are respectively inverted by inverters 28-1 to 28-n, with the result that the thyristors are not triggered when the detecting circuits 19-1 to 19-n are generating their outputs, and a triggering signal is applied to gate electrodes of the thyristors only when the detecting circuits 19-1 to 19-n are not generating their outputs. In this case, it is also arranged so that each of the alarm signal transmitters always generates a low frequency signal, and the generation of the low frequency signal is stopped in response to an output signal of the associated sensor or the like. With this construction, in the normal condition each of the detecting circuits 19-1 to 19-n always generates an output according to the operating timing of the associated pair of the switching means 16-1 to 16-n and 22-1 to 22-n, but the inverters 28-1 to 28-n prevent the application of a triggering signal to the thyristors. As a result, the display devices which are not selected by the operation of the shift register 26 through the switching means 22-1 to 22-n, are not energized due to the associated thyristors being disconnected from the supply voltage $+V_1$ and also the selected display devices are not energized due to the fact that the outputs of the detecting circuits 19-1 to 19-n are inverted by the inverters 28-1 to 28-n thus preventing the triggering of the thyristors. When in this condition, the generation of low frequency signal from any one (or more) of the transmitters is stopped, the inverter of the corresponding detector generates a triggering signal, and consequantly at the instant that the corresponding first and second switching means are actuated by the operation of the shift register 26, the display device corresponding to the transmitter stopping the generation of its low frequency signal comes into operation.

With the embodiment shown in FIG. 4, each display device comes into operation not only when the corresponding transmitter stops the generation of low frequency signal, but also when the modulated signal fails to arrive the receiving panel or when the applied modulated output contains no low frequency signal, thus making it possible to utilize the system for detecting the breakage of the wire, the failure of the device or the like in the circuitry interconnecting the receiving panel and the transmitters. More specifically, in the event that one of the display devices comes into operation and non-existence of any abnormal condition, e.g., flame or the like in the service area of the sensor connected to the corresponding transmitter is confirmed, a check is made by presuming that the trouble has been caused by a break in the line between the transmitter and the splitter shown in FIG. 1 or the failure of the transmitter. Also in the event that all of the display devices in any group, e.g., the display devices 20-2-1 to 20-2-k of the second group come into operation and non-existence of abnormal condition on the part of the subscribers in the corresponding group unit is confirmed, a check is made by presuming that this condition has been caused by a break in the line connecting the modulator 6-2 to the transmitters 8-2-1 to 8-2-k or the failure of the modulator 6-2 itself.

It will thus be seen from the foregoing that in accordance with the present invention, the number of the required bandpass filters and detecting circuits for selecting and detecting the frequencies of low frequency signals can respectively be reduced to the same number as that of the subscribers forming each group unit, thus reducing the occurrence of troubles and making easier the location of faults causing the troubles. Further, in the event that a plurality of alarm signals are generated simultaneously displayed accurately thus ensuring discrimination of the locations of the corresponding subscribers.

We claim:

1. In an alarm system for subscribers having locations in group units and utilizing a bidirectional wired television system, said alarm system comprising a plurality of alarm signal transmitters located at the subscribers locations, said signal transmitters generating low frequency signals of frequencies common to respective of said group units, said frequencies being different for respective subscribers in respective group units, each of said transmitters being provided for each said subscriber; modulators for respective of said group units for modulating the low frequency signals from said alarm signal transmitters with different high frequency carrier signals; and an alarm signal receiving panel coupled to said modulators for receiving said modulated signals, said receiving panel including a plurality of demodulators for respective of said group units for demodulating said modulated signals through frequency selection in response to said high frequency carrier signals utilized for modulation, a plurality of detectors corresponding to the subscribers in each of said group units, said detectors being adapted to receive in common the output of each of said demodulators to detect the same through frequency selection in response to said low frequency signals, and a plurality of display means connected to said detectors and responsive to the presence or absence of the output of said detectors to display the locations of the alarm signal transmitters which have generated the low frequency signals or have stopped the generation of the low frequency signals, the improvement wherein:

(a) said display means includes a plurality of display devices provided one for each of said subscribers, said display devices being formed into similar groups to correspond to said subscribers, the display devices in each of said groups being connected to one of said detectors through a plurality of semiconductor control devices to display the locations of the corresponding ones of said subscribers; and (b) said receiving panel further includes a plurality of first switching means for switching said demodulators to energized or deenergized condition, a plurality of second switching means each thereof connected to a corresponding group of said display devices to switch the same to energized or deenergized condition, said plurality of semiconductor control devices each thereof connected to one of said detectors, one of said second switching means and one of said display devices to actuate said one display device when each of said one detector and said one second switching means generates an output, and a scanning controller for sequentially energizing said first switching means and said second switching means periodically to periodically energize said demodulators and said groups of display devices sequentially for each of said group units.

2. An alarm system according to claim 1, wherein each of said subscribers is provided with a hazard sensor, and wherein said alarm signal transmitter located at each said subscriber is connected to an output of said hazard sensor whereby said transmitter generates a low frequency signal in response to the generation of an output signal from said hazard sensor.

3. An alarm system according to claim 1, wherein each of said subscribers is provided with a hazard sensor, wherein said alarm signal transmitter located at each said subscriber is connected to an output of said hazard sensor, wherein said alarm signal transmitter always generates a low frequency signal, said transmitter being adapted to stop the generation of said low frequency signal when said hazard sensor connected thereto generates an output signal, and wherein each of said detectors includes signal inverting means connected to the output thereof whereby said signal inverting means applies an output to said semiconductor control devices only when there is no low frequency signal in said demodulated signal from said demodulator.

4. An alarm system according to claim 1, wherein said scanning controller includes a clock pulse generator for generating clock pulses of a predetermined repetition period, a counter of arbitrary number $n$ adapted to receive and to be driven by the clock pulses from said pulse generator, said number $n$ being equal to the number of said group units, and a shift register having the same number of output terminals as said number $n$, said shift register being adapted to be driven by said clock pulses and reset by an output of said counter, said shift register being responsive to each of said clock pulses to periodically and sequentially apply an energizing signal to each of said first and second switching means for each of said group units.

5. An alarm system according to claim 1 further comprising an antenna, a bidirectional amplifier connected to said modulators, and a signal separator connected in series between said antenna and said bidirectional amplifier, said signal separator being connected to said receiving panel.

6. An alarm system according to claim 1, wherein each of said group units includes a plurality of splitters connected to said group unit modulator, and wherein each of said splitters is connected to a television set and said alarm signal transmitter associated with one of said subscribers.

* * * * *